US008469592B2

(12) United States Patent
Pawloski

(10) Patent No.: US 8,469,592 B2
(45) Date of Patent: Jun. 25, 2013

(54) TACTILE ENHANCEMENT MECHANISM FOR A CLOSURE MECHANISM

(75) Inventor: James C. Pawloski, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 339 days.

(21) Appl. No.: 12/820,680

(22) Filed: Jun. 22, 2010

(65) Prior Publication Data

US 2011/0311168 A1 Dec. 22, 2011

(51) Int. Cl.
*B65D 33/16* (2006.01)

(52) U.S. Cl.
USPC ..... 383/63; 383/65

(58) Field of Classification Search
USPC ..... 383/63–65; 24/585.11, 585.12, 399, 24/400, DIG. 50, DIG. 39, DIG. 40
See application file for complete search history.

(56) References Cited

U.S. PATENT DOCUMENTS

| | | | | |
|---|---|---|---|---|
| 4,186,786 | A | 2/1980 | Kirkpatrick | |
| 4,285,105 | A | 8/1981 | Kirkpatrick | |
| 4,363,345 | A * | 12/1982 | Scheibner | 383/63 |
| 4,479,244 | A | 10/1984 | Ausnit | |
| 4,736,496 | A | 4/1988 | Fisher et al. | |
| 4,822,539 | A | 4/1989 | Tilman et al. | |
| 4,929,487 | A | 5/1990 | Tilman et al. | |
| 5,070,584 | A | 12/1991 | Dais et al. | |
| 5,138,750 | A | 8/1992 | Gundlach et al. | |
| 5,209,574 | A * | 5/1993 | Tilman | 383/63 |
| 5,211,481 | A | 5/1993 | Tilman | |
| 5,307,552 | A | 5/1994 | Dais et al. | |
| 5,382,094 | A | 1/1995 | Ausnit | |
| 5,384,942 | A * | 1/1995 | Siegel | 24/585.12 |
| 5,509,734 | A | 4/1996 | Ausnit | |
| 5,647,100 | A * | 7/1997 | Porchia et al. | 24/30.5 R |
| 5,722,128 | A * | 3/1998 | Toney et al. | 24/400 |
| 5,774,955 | A | 7/1998 | Borchardt et al. | |
| 5,791,783 | A | 8/1998 | Porchia et al. | |
| 6,186,663 | B1 * | 2/2001 | Ausnit | 383/63 |
| 6,592,260 | B1 * | 7/2003 | Randall et al. | 383/64 |
| 6,877,898 | B2 | 4/2005 | Berich et al. | |
| 6,955,465 | B2 | 10/2005 | Machacek et al. | |

(Continued)

FOREIGN PATENT DOCUMENTS

JP 2009196658 A * 9/2009

OTHER PUBLICATIONS

U.S. Appl. No. 12/455,205, filed May 29, 2009.

*Primary Examiner* — Jes F Pascua

(57) ABSTRACT

A pouch including a first sidewall. A second sidewall connects to the first side sidewall so as to form an interior of the pouch with an opening to the interior. A closure mechanism extends along an interior surface of the first sidewall for sealing the opening. The closure mechanism extends from one end of the opening to an opposite end of the opening. A first tactile strip is disposed on an exterior surface of the first sidewall and is spaced above the closure mechanism. A second tactile strip is disposed on the exterior surface of the first sidewall and is spaced below the closure mechanism. An exterior surface of at least one of the first tactile strip and the second tactile strip is provided with a texture, with the texture including a plurality of openings that open into the exterior surface. A smooth region is formed on the exterior surface of the first sidewall. The smooth region is disposed opposite to the closure mechanism and extends between the first and second tactile strips.

6 Claims, 2 Drawing Sheets

U.S. PATENT DOCUMENTS

| | | | | |
|---|---|---|---|---|
| 7,137,736 | B2 | 11/2006 | Pawloski et al. | |
| 7,410,298 | B2 | 8/2008 | Pawloski | |
| 7,651,271 | B2 * | 1/2010 | Withers | 383/63 |
| 2002/0153273 | A1 * | 10/2002 | Mallik et al. | 206/459.1 |
| 2004/0013323 | A1 * | 1/2004 | Withers | 383/63 |
| 2004/0078939 | A1 * | 4/2004 | Pawloski | 24/400 |
| 2004/0086604 | A1 * | 5/2004 | Grandey | 426/106 |
| 2006/0104548 | A1 * | 5/2006 | Schreiter | 383/63 |
| 2007/0206888 | A1 | 9/2007 | Chang | |
| 2008/0159662 | A1 | 7/2008 | Dowd et al. | |
| 2010/0303390 | A1 * | 12/2010 | Ackerman et al. | 383/61.2 |
| 2011/0044566 | A1 * | 2/2011 | Fish et al. | 383/63 |

* cited by examiner

TACTILE ENHANCEMENT MECHANISM FOR A CLOSURE MECHANISM

CROSS REFERENCE TO RELATED APPLICATIONS

—Not applicable—

REFERENCE REGARDING FEDERALLY SPONSORED RESEARCH OR DEVELOPMENT

—Not applicable—

SEQUENTIAL LISTING

—Not applicable—

BACKGROUND

1. Field of the Invention

The present disclosure generally relates to a tactile enhancement mechanism for a closure mechanism of a resealable pouch.

2. Description of the Background of the Invention

Resealable pouches in the form of thermoplastic bags with elongate closure mechanisms have been developed of a type that includes one or more sets of closure mechanisms, such as interlocking closure profiles, for maintaining the pouch in a sealed condition. In some pouches, these closure profiles may be difficult for a user to locate and/or to operate, such that the pouch cannot be occluded properly, because the user is unable to visually see the closure profiles and/or is unable to easily feel the location of the closure profiles. In such cases, incomplete occlusion does not allow the pouch to be sealed properly, and the contents of the pouch may escape or spoil.

Various attempts have been made to help users locate and properly occlude closure profiles. For example, one design provides a reclosable bag having front and rear walls and a single pair of mutually interlocking opposing rib and groove closure elements disposed across a mouth of the bag. Outer surfaces of the walls are roughened coextensive with and over the rib and groove elements by a series of vertical ridges with vertical valleys therebetween to facilitate a user's application of a tangential force to open the closure elements.

Another design provides a reclosable bag having alignment ribs disposed on opposite sides of a male interlocking profile on an interior side of a first bag wall. Outer ridge beams coextensive with a central stabilizing ridge are extruded on the first bag wall exterior surface opposite to the alignment ribs and the male interlocking profile, respectively.

A further design provides a reclosable bag having front and rear walls and nested inner and outer closure mechanisms disposed on interior surfaces of the walls. A pair of parallel, spaced apart ribs is disposed on an external surface of the front wall and is aligned with legs of an outer female interlocking member. Another pair of parallel ribs is disposed on an external surface of the rear wall spaced on opposite sides of an inner female interlocking member.

Yet another design provides a reclosable bag having opposing walls and a single pair of mutually interlocking opposing rib and groove closure elements disposed across an interior of a mouth of the bag. Backing areas made of a material that is dissimilar to the closure elements are provided on the bag walls in alignment with the closure elements, on exterior surfaces of the opposing bag walls or between the closure elements and the bag walls. The dissimilar material of the backing areas provides a noticeable tactile feel for a user in regards to other areas of the bag, in order to help the user feel the location of the closure elements.

Many designs found in the art include a guiding mechanism disposed directly opposite to the closure profile, such that a ridge is located on a back side of the closure profile, and a user is able to position his or her fingers on the ridge to help guide occlusion. A problem with such designs, however, is that a user's finger may slide off of the ridge of material, which may cause uneven or incomplete occlusion along an entire length of the opening into the bag, thereby forming an incomplete seal across the opening.

SUMMARY

According to one aspect, a pouch includes a closure strip along an interior surface of a pouch sidewall for sealing an opening into the pouch. The closure strip extends from one end of the opening to an opposite end of the opening. A first tactile strip is disposed on an exterior surface of the pouch sidewall spaced above the closure profile, and a second tactile strip is disposed on the exterior surface of the pouch sidewall spaced below the closure profile. Each of the first and second tactile strips extends substantially to opposite ends of the closure mechanism, and an exterior of at least one of the first and second tactile strips is textured. A smooth region on the exterior surface of the first pouch sidewall is disposed opposite to the closure mechanism extending completely between the first and second tactile strips.

Another aspect of the disclosure includes a tactile enhancement mechanism for a closure mechanism on a pouch, wherein the closure mechanism includes an elongate closure strip disposed on an interior surface of a sidewall of the pouch and extends from one end of a mouth into the pouch to another end of the mouth for closing the mouth. The tactile enhancement mechanism includes a first strip of material secured to the exterior surface of the sidewall below the closure strip and a second strip of material secured to the exterior surface of the sidewall above the closure profile. The first and second strips of material extend to opposite ends of the closure strip, and the first strip of material has a textured exposed surface. A smooth region on the exterior surface of the sidewall is coextensive with the closure strip between the first and second strips of material.

According to yet a further aspect, a reclosable pouch includes first and second opposing pouch walls defining an interior therebetween and an opening into the interior, an elongate resealable closure profile that extends longitudinally between opposite ends of the opening and includes a first closure member disposed on an interior surface of the first pouch wall, and first and second strips of material attached to an exterior surface of the first pouch wall. Each of the first and second strips of material is substantially parallel to, and immediately adjacent to, the closure mechanism, and includes a tactile pattern that forms a textured exterior surface. A region of the exterior surface that is disposed between the first and second regions and directly opposite to the closure member is smooth.

Other aspects and advantages of the present disclosure will become apparent upon consideration of the drawings and the following detailed description, wherein similar structures have similar reference numbers.

DETAILED DESCRIPTION

Figure 1:
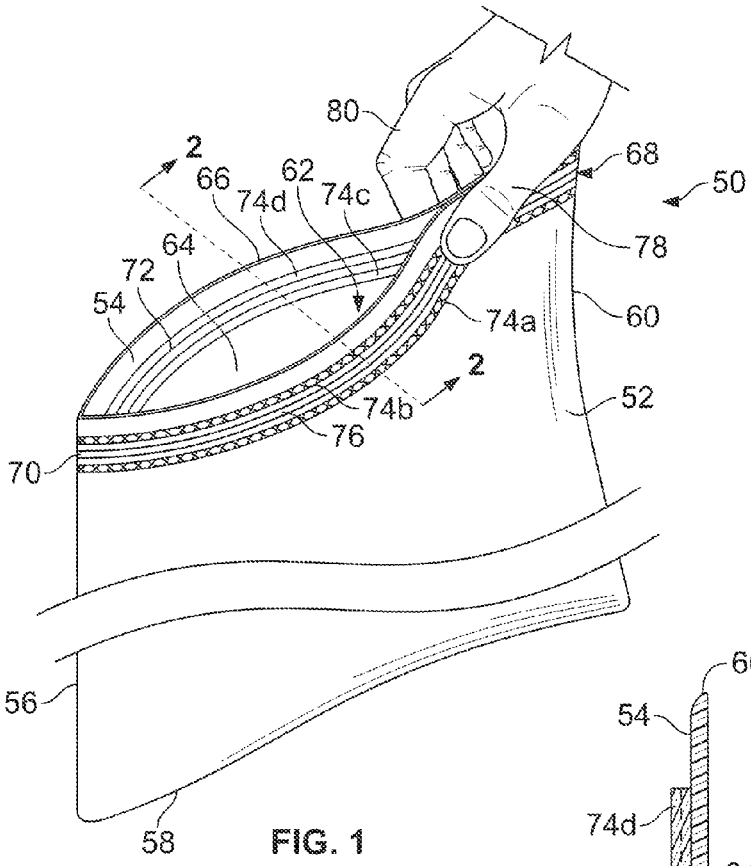
FIG. 1 is an isometric view of a pouch having a tactile enhancement mechanism of the present invention.

In FIG. 1, a reclosable pouch 50 has a tactile enhancement mechanism of the present invention that includes at least one additional layer of material added to the exterior surface of the pouch and acts to enhance the tactile sensation to a user's fingers and acts as a guiding mechanism, such that a user can properly position his/her fingers for occlusion. The pouch 50 has a first sidewall 52 and a second sidewall 54 that are connected by, for example, folding, heat sealing, and/or an adhesive, along three edges 56, 58, 60, to define an interior space 62 between the first and second sidewalls 52, 54. An opening 64 defining a mouth that allows access into the interior space 62 is located along a top edge 66 where the first and second pouch sidewalls 52, 54 are not connected. The first and second sidewalls 52, 54 are preferably made of thermoplastic, such as polyethylene, polypropylene, and blends of such constituents, may include other additives as desired, and may be extruded and formed in any suitable manner known in the art. The sidewalls 52, 54 may be made of and/or include other flexible materials, such as paper, foil, and/or cloth.

A closure mechanism 68 extends longitudinally adjacent to the top edge 66 and includes a first elongate closure strip 70 and a second elongate closure strip 72 that can be sealed together along the length of the opening 64 to close the mouth. The first closure strip 70 is disposed along an inside surface of the first sidewall 52 near the opening 64 and extends to the side edges 56, 60 of the pouch 50, and the second closure strip 72 is disposed along an inside surface of the second sidewall 54 near the opening 64 and also extends between side edges 56, 60 of the pouch 50. The closure strips 70, 72, are substantially aligned opposite to each other, such that the opening 64 may be repeatedly opened and/or closed, preferably, thereby respectively sealing and unsealing the opening 64. The closure mechanism 68 and the closure strips 70 and 72 thereof may take many different forms suitable for closing the opening 62, some of which are exemplified herein, and the invention is not necessarily limited to any particular form of the embodiments illustrated. Preferably, the closure mechanism 68 is a "pinch and seal" type interlocking "zipper" closure, wherein each of the first and second closure strips 70, 72 has one or more mutually interlocking elongate profiles, and wherein each profile has a substantially constant cross section that extends completely between side edges 56, 60 of the pouch 50. The closure mechanism 68 may include mutually interlocking profiles of various different designs, such as male and female closure profiles, hook profiles, rib and groove profiles, etc.; however, other types, sizes, and shapes of closure mechanisms sufficient to close the mouth of a bag may be used, such as adhesive closures and/or hook-and-loop type closures. Still further, the closure mechanism 68 may be attached to the pouch 50 in any manner suitable to effectuate closing of the mouth. Illustratively, the closure strips 70, 72 may be formed integrally with the sidewalls 52, 54, may be formed separately and subsequently attached to the sidewalls 52, 54, or any combination thereof using any number of suitable methods, including heat sealing, integral casting, adhesive sealing, and various hybrid methods of manufacturing. Some exemplary pouches and closure mechanisms usable in the invention are disclosed in Dais et al. U.S. Pat. No. 5,070,584, Dais et al. U.S. Pat. No. 5,307,552, Ausnit U.S. Pat. No. 5,382,094, Borchardt et al. U.S. Pat. No. 5,774,955, Berich U.S. Pat. No. 6,877,898, Pawloski U.S. Pat. No. 7,410,298, and Dowd et al. U.S. Patent Application Publication No. 2008/0159662, each of which is incorporated by reference in its entirety herein.

The tactile enhancement mechanism is attached to an exterior side of the pouch 50 adjacent to and offset laterally up and/or down from the closure mechanism 68. The tactile enhancement mechanism includes one or more tactile strips 74*a*, 74*b*, 74*c*, 74*d*, each formed of one or more layers of material attached to the exterior surface pouch 50, with an optionally textured outer surface that is exposed to a user's fingers when closing the closure mechanism 68 and located to help to provide a unique tactile sensation to the user's fingers over the closure strips 70 and/or 72. First and third tactile strips 74*a* and 74*c* are disposed on respective sidewalls 52, 54 in a region immediately below the first and second closure strips 70, 72, and second and fourth tactile strips 74*b* and 74*d* are disposed on the sidewalls 52, 54 in a region immediately above the first and second closures 70, 72. Preferably, the tactile strips 74*a*-74*d* have the form of elongate strips that extend approximately parallel with and along the entire length of the closure mechanism 68, although the tactile strips 74*a*-74*d* are not necessarily limited to any particular exact shape herein. An exterior surface of each or any of tactile strips 74*a*-74*d* may be textured in any form sufficient to provide an additional tactile feedback cue to the user, such as with bumps, ribs, notches, slits, cuts, embossing, roughening, designs, holes, abscesses, and indentations. An exemplary texture shown in FIG. 1 is a series of X-shaped indentations that may be formed by embossing or cutting partly or completely through the layer(s) of material of the tactile strips. Other patterns that provide some sort of texture transverse to the axes of the strips 74*a*-74*d*, such as vertical, slanted, circular, or diamond shaped cuts or ridges, may be used and are contemplated to be within the scope of the disclosure. The tactile strips 74*a*-74*d* of the tactile enhancement mechanism help to ensure positive closure of the closure mechanism 68 by providing both a shape that urges the user's fingers to a position directly opposite to the closure mechanism 68 and a tactile cue that provides additional tactile feedback to the user to easily feel where the outer bounds of the closure strips 70 and/or 72 are and where the user's finger's should be to ensure successful closure of the closure mechanism 68. The tactile enhancement mechanism may have alternate forms, wherein fewer than four of the tactile strips 74*a*-74*d* may be used, such as having only tactile strips 74*a* and 74*b* on the pouch wall 52, having only lower tactile strips 74*a* and 74*c*, having only upper tactile strips 74*b* and 74*d*, or other combinations of the tactile strips 74*a*-74*d*. It should be understood that the term "layer" encompasses any amount, shape, and/or size of material that is applied to the pouch 50 that provides a tactile sensation to a user's fingers when closing the closure mechanism consistent with the description and objects discussed herein. The tactile enhancement mechanism may also urge the user's fingers into a position directly opposite to the closure strips 70, 72 by providing a flat, smooth area 76 coextensive with the closure mechanism 68 over which the user's fingers slide more readily, and bounded on one or both sides of the closure mechanism 68 by the tactile strips.

The tactile strips 74*a*-74*d* may be formed of many different materials and/or applied in different ways. For example, the tactile strips 74*a*-74*d* may be made of thermoplastic, such as polyethylene, polypropylene, and blends thereof. The tactile strips 74*a*-74*d* may be made of paint, ink, paper, cloth, adhesive decals, or other material suitable for the purposes described herein. Further, the tactile strips 74*a*-74*d* may be attached to the pouch 50 by any method suitable for application, such as by extrusion, heat sealing, adhesive, spraying, and/or printing. In one example, the tactile strips 74*a*-74*d* are formed by extruding a layer or bead of thermoplastic onto the pouch and subsequently embossing or cutting exterior surfaces of the tactile strips 74*a*-74*d* with an embossing wheel or cutting mechanism. In another example, the layer(s) of material of the tactile strips 74*a*-74*d* may be ink or thermoplastic that is sprayed onto the pouch 50 in a series of shapes adjacent to the closure mechanism, for example, with a hot melt adhesive application system. In another example, the layer(s) of material of the tactile strips 74*a*-74*d* may be printed on to the pouch 50 in a series of shapes adjacent to the closure mechanism using a flexographic printing machine. Further, the layer (s) of the tactile strips 74*a*-74*d* may be applied in any thickness sufficient to provide a meaningful tactile feel to an average user's fingers as described. Preferably, the layers are between about 0.005 mm to about 5 mm thick, and, more preferably, about 0.02 mm thick.

In one standard method of use, when it is desired to close the closure mechanism 68, the closure strips 70, 72 are squeezed together between a user's fingers 78, 80, for example, beginning at one end of the closure mechanism and drawing the fingers along the entire length of the closure mechanism 68 to thereby squeeze the closure strips 70, 72 together along the entire length thereof. The added layer(s) of material of the tactile enhancement mechanism may guide the user's fingers 78, 80 onto the smooth regions 76 opposite to the closure strips 70, 72, thereby guiding the user's fingers 78, 80 into an optimal position for successfully closing the closure strips 70, 72 as the user moves fingers 78, 80 from edge 60 to edge 56, for example, while applying inward pressure to successfully close the pouch 50. Further, a textured exterior surface of the tactile strips 74*a*-74*d*, as disclosed herein, also provides a tactile sensation in the form of a roughened sensation that provides the user with additional tactile feedback that signals to the user whether his/her fingers 78, 80 are correctly positioned in the smooth space 76 directly opposite to and aligned with the closure mechanism 68.

Figure 2:
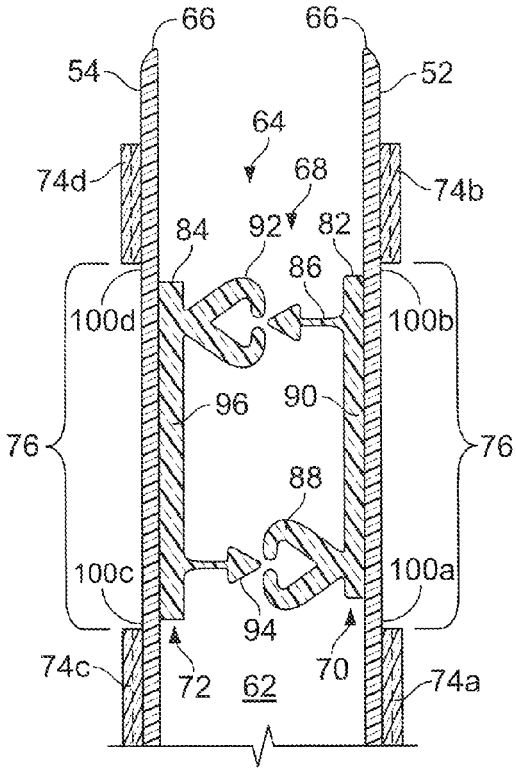
FIG. 2 is a cross-sectional view of an exemplary closure mechanism usable with the tactile enhancement mechanism, taken generally along the lines 2-2 of FIG. 1, with portions behind the plane of the cross section omitted for clarity.

Turning now to some exemplary embodiments shown in FIGS. 2-5, in FIG. 2, the first closure strip 70 includes a first base 82 attached to an interior surface of the first sidewall 52, and the second closure strip 72 includes a second base 84 attached to an interior surface of the second sidewall 54. In other embodiments, one or both of the first and second closure strips 70, 72 may be integral with the respective first and second sidewalls 52, 54. The first closure strip 70 includes a first interlocking member 86 that has an arrow shape disposed at a first end of the first base 82, a second interlocking member 88 that has a channel shape disposed at a second end of the first base 82, and a medial portion 90 between the first interlocking member 86 and the second interlocking member 88, wherein the first interlocking member 86 and second interlocking member 88 both extend from the first base 82 toward the second base 84. The second closure strip 72 includes a third interlocking member 92 that has a channel shape disposed at a first end of the second base 84, a fourth interlocking member 94 that has an arrow shape disposed at a second end of the second base 84, and a medial portion 96 between the third interlocking member 92 and the fourth interlocking member 94, wherein the third interlocking member 92 and the fourth interlocking member 94 extend from the second base 84 toward the first base 80. The first interlocking member 86 occludes with the third interlocking 92 member and the second interlocking member 88 occludes with the fourth interlocking member 94. Although the closure strips 70 and 72 are shown with two sets of interlocking profiles, it is contemplated that any number and combination of interlocking profiles sufficient to close the opening 64 may be used. Each of the tactile strips 74*a*-74*d* is disposed adjacent to one of the closure strips 70, 72, and flat, smooth regions 76 are formed immediately opposite to and coextensive with the closure strips 70, 72 between the tactile strips. The tactile strips 74*a*-74*d* are preferably spaced above and below the closure mechanism 68 such that, for example, small gaps 100*a*-100*d* are formed between the first and second ends of bases 82, 84 and the respective tactile strips 74*a*-74*d*. The gaps 100*a*-100*d* are preferably each between about 0.1 mm to about 10 mm, and, more preferably, between about 0.5 mm to about 2 mm.

Figure 3:
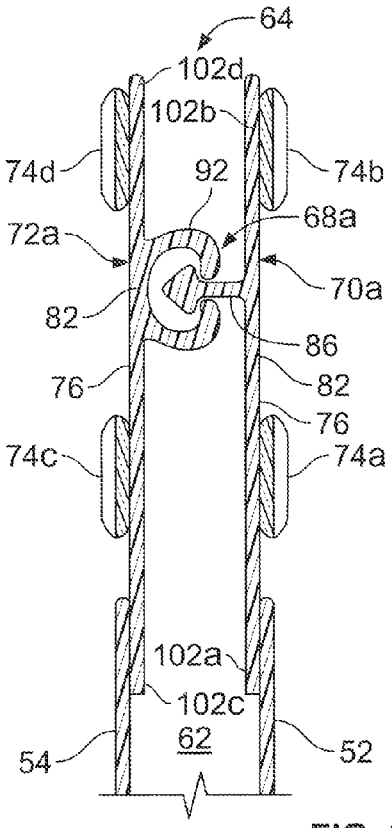
FIG. 3 is a cross-sectional view of a different exemplary closure mechanism with the tactile enhancement mechanism, taken generally along the lines 2-2 of FIG. 1, with the closure mechanism closed and portions behind the plane of the cross section omitted for clarity.

In FIG. 3, a tactile enhancement mechanism on a pouch 50 is shown with another closure mechanism 68*a* including closure strips 70*a*, 72*a* having a different profile. The closure mechanism 68*a* has first and second closure strips 70*a*, 72*a* that extend along the length of the opening 64. Each closure strip 70*a*, 72*a* has a profile defining an interlocking member 86 or 92 projecting from an inside surface of a base member 82. Upper and lower flange members 102*a*, 102*b*, 102*c*, 102*d* extend upwardly and downwardly from a respective base member 82 and each lower flange member 102*a*, 102*c* is secured to a respective sidewall 52, 54 of the pouch 50 along the opening 64, such that the first closure strip 70*a* occludes with the second closure strip 72*a*. Tactile strips 74*a*, 74*b*, 74*c*, and 74*d* defining a tactile enhancement mechanism are attached to the exterior surfaces of the upper and lower flange members 102 in the manner shown in FIG. 1. The first tactile strip 74*a* is spaced below the interlocking member 86, and the second tactile strip 74*b* is spaced above the interlocking member 88, thereby leaving an intermediate flat, smooth region 76 coextensive with the interlocking member. Optionally, third and fourth tactile strips 74*c*, 74*d* may be attached to the exterior surfaces of the opposite upper and lower flanges 102*c*, 102*d*, with the third tactile strip 74*c* spaced below the interlocking member 92 and the fourth tactile strip 74*d* spaced above the interlocking member and another flat, smooth region 76 disposed therebetween.

Figure 4:
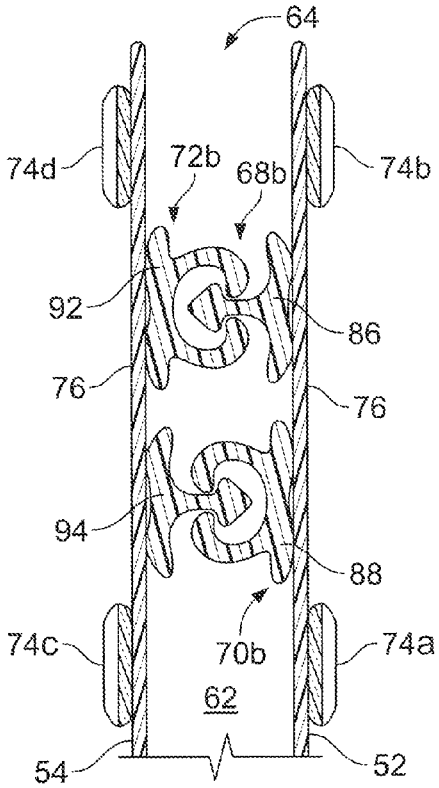
FIG. 4 is a cross-sectional view of another exemplary closure mechanism with the tactile enhancement mechanism, taken generally along the lines 2-2 of FIG. 1, with the closure mechanism closed and portions behind the plane of the cross section omitted for clarity.

In FIG. 4, a tactile enhancement mechanism on a pouch 50 with a further closure mechanism 68*b* is generally similar to closure mechanism 68, but includes closure strips 70*b*, 72*b* having yet a different profile. Closure strip 70*b* includes upper and lower interlocking members 86 and 88, and closure strip 70*b* includes upper and lower interlocking members 92 and 94. The upper interlocking members 86, 92 are spaced apart from the lower interlocking members 88, 94 and extend along the length of the closure mechanism 68*b*. Each interlocking member 86, 88, 92 and 94 is attached directly to an inside surface of a sidewall 52 or 54 of the pouch 50 along the opening 64 such that the upper interlocking members 86 and 92 occlude together and the lower interlocking members 88 and 94 occlude together. Tactile strips 74*a*, 74*b*, 75*c*, 74*d* of the tactile enhancement mechanism are attached to exterior surfaces of the sidewalls 52 or 54 of the pouch 50. The tactile strip 74*b* is spaced above the closure mechanism, and the tactile strip 74*a* is spaced below the closure mechanism, thereby leaving a flat, intermediate smooth region 76 coextensive with the interlocking members 86, 88, where the sidewall 52 of the pouch 50 is exposed with no tactile strip. Optionally, the tactile strips 74*c* and 74*d* may be attached to the exterior surface of the opposite sidewall 54 of the pouch 50, with the tactile strip 74*d* spaced above the closure mechanism and the tactile strip 74*c* spaced below the closure mechanism, thereby leaving a flat, smooth portion 76 of the sidewall 54 therebetween opposite to the interlocking members 92, 94. Preferably, the tactile strips 74*a*-74*d* extend parallel to and along the entire length of the closure mechanism 68*b*, as shown in FIG. 1.

Each tactile strip 74*a*-74*d* shown in FIGS. 2-4 preferably has a textured exterior surface, such as formed by slices, slits, indentations, holes, or other texture that may be readily felt by a user's fingers along the exterior side thereof, as described with respect to FIG. 1. The tactile strips 74*a*-74*d* may be formed of a bead of material that is applied to the exterior of the pouch, such as thermoplastic extruded directly onto a side wall, may be a strip of material that is post-applied to the exterior of the pouch, or may be formed by any other method sufficient to secure the layer(s) of material to the exterior of a pouch adjacent to the closure mechanism, as described previously herein. Further, the tactile strips 74*a*-74*d* preferably are not aligned directly opposite to (behind) the closures 70, 72, such as the bases 82, 84 of FIG. 2, or the interlocking profiles of FIGS. 3 and 4, and the flat, smooth regions 76 include substantially no material added to the sidewalls of the pouch.

Figure 5:
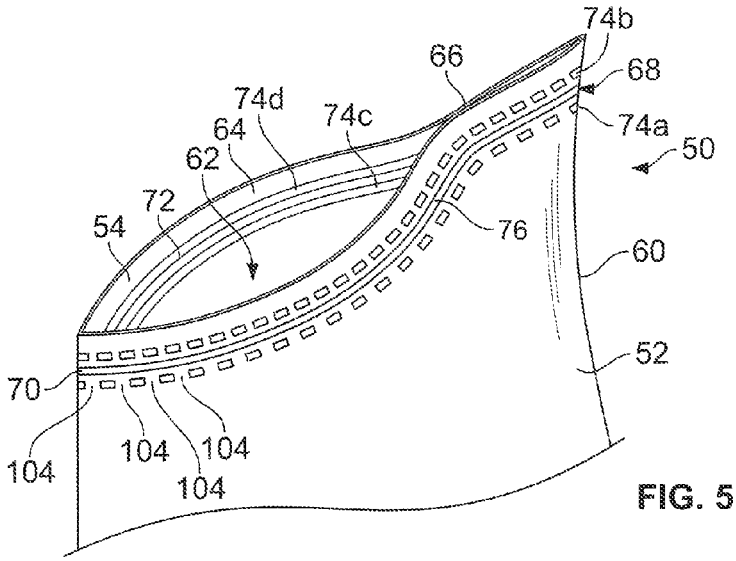
FIG. 5 is a fragmentary isometric view of a pouch with another variation of the tactile enhancement mechanism.

In a further embodiment, shown in FIG. 5, the tactile enhancement mechanism comprises at least one, and, preferably, two tactile strips 74*a*, 74*b*, wherein the tactile strips extend along the length of the sidewalls 52, 54 in a region immediately above and/or below the first closure profile 70 and are discontinuous. A flat, smooth region 76 is defined between the tactile strips 74*a*, 74*b* coextensive with the closure mechanism 68 as disclosed previously herein. The tactile strips 74*a*, 74*b* are discontinuous, having breaks 104 disposed at intervals along the length of the pouch 50, as shown in FIG. 5. The intervals between successive breaks 104 can be constant or irregular. The breaks 104 in the tactile strips 74*a*, 74*b* may provide the textured surface alone, or additional texturing may be imparted to the tactile strips in any manner as suggested herein. The tactile strips 74*a*, 74*b* may be disposed only on one sidewall 52 of the pouch 50 (as shown in FIG. 5) or additional tactile strips (not shown) may be disposed in a similar position with respect to the closure mechanism on both pouch 50 sidewalls 52, 54, as disclosed previously herein. Some of the tactile strips 74*a*-74*d* may be continuous, as shown in FIG. 1, and others of the tactile strips may be discontinuous, as shown in FIG. 5.

Any of the tactile enhancement mechanisms disclosed herein may be manufactured in a variety of shapes and sizes and may take various forms sufficient to provide the functions disclosed herein.

INDUSTRIAL APPLICABILITY

A tactile enhancement mechanism of the present invention may help to guide a user's fingers into the proper position along a closure mechanism, to ensure complete and/or proper closure of the closure mechanism, by providing tactile cues and feedback that help a user place his/her fingers in an optimal position for effectuating closure. A tactile enhancement mechanism placed at locations adjacent, above and/or below the closure mechanism can, in some cases, also overcome one or more challenges of the prior art discussed herein.

While specific embodiments are discussed herein, it is understood that the present disclosure is to be considered only as an exemplification of the principles of the disclosure. Numerous modifications to the present disclosure will be apparent to those skilled in the art in view of the foregoing description without departing from the principles of the disclosed invention. Accordingly, this description is to be construed as being illustrative only, and is presented for the purpose of enabling those skilled in the art to make and to use the disclosure, and to teach the best mode of carrying out the same.

We claim:

1. A reclosable pouch comprising:

a first sidewall;

a second sidewall connected to the first side sidewall so as to form an interior of the pouch with an opening to the interior;

an elongate resealable closure profile that extends longitudinally between opposite ends of the opening and includes a closure member disposed on an interior surface of the first sidewall; and first and second strips of material attached to an exterior surface of the first sidewall, each of the first and second strips of material being substantially parallel to and immediately adjacent to the closure member, and each of the first and second strips of material including a tactile pattern forming a texture on the exterior surfaces of the first and second strips of material, the texture including a plurality of openings into the exterior surfaces of the first and second strips of material, wherein a region of the exterior surface of the first sidewall that is disposed between the first and second strips of material and directly opposite to the closure member is smooth.

2. The reclosable pouch of claim 1, wherein the closure profile further includes a base attached to the first sidewall, and the region of the exterior surface of the first sidewall is coextensive with the base.

3. The reclosable pouch of claim 1, wherein the first and second strips of material are adapted to guide fingers of a user into a position aligned opposite to the closure profile for occlusion.

4. The reclosable pouch of claim 1, wherein the texture on the exterior surfaces of the first and second strips of material comprises a cross-hatched pattern.

5. The reclosable pouch of claim 4, wherein the first and second strips of material are continuous and extend along the entire length of the closure profile.

6. The reclosable pouch of claim 1, wherein the openings are at least one of notches, slits, cuts, embossing, holes, abscesses, and indentations.

* * * * *